United States Patent [19]

Geczy

[11] 4,253,532

[45] Mar. 3, 1981

[54] IN-HOLE MOTOR DRILL WITH LOCKING BIT CLUTCH

[75] Inventor: Bela Geczy, Glendale, Calif.

[73] Assignee: Smith International, Inc., Newport Beach, Calif.

[21] Appl. No.: 67,882

[22] Filed: Aug. 20, 1979

[51] Int. Cl.[3] ..... E21B 4/02

[52] U.S. Cl. ..... 175/107

[58] Field of Search ..... 175/107, 101, 293, 207; 418/48

[56] References Cited

U.S. PATENT DOCUMENTS

| | | | |
|---|---|---|---|
| 4,135,772 | 1/1979 | Stodt | 175/107 |
| 4,187,918 | 7/1980 | Clark | 418/48 |

FOREIGN PATENT DOCUMENTS

| | | | |
|---|---|---|---|
| 291027 | 12/1971 | U.S.S.R. | 175/107 |

*Primary Examiner*—William F. Pate, III

*Attorney, Agent, or Firm*—Philip Subkow; Bernard Kriegel

[57] ABSTRACT

An in-hole motor drill assembly has the rotor of the motor which may be connected to the drill bit through a shaft connected to the rotor, and a housing which may be connected to the running string, and normally disengaged torque transmitting members between said housing and said shaft. Means are provided for engaging said shaft and said housing for mutual rotation by exerting a negative force on said housing, if the bit is stuck. The shaft can be rotated by rotation of the housing in either direction when mounted in a well and the housing connected to a drill string and the shaft connected to a bit. In normal operation, during drilling, the housing is disengaged to permit the shaft to rotate relative to the housing.

23 Claims, 4 Drawing Figures

IN-HOLE MOTOR DRILL WITH LOCKING BIT CLUTCH

THE PRIOR ART

The prior art is Russian Pat. No. 395,557 granted Nov. 22, 1973, and the application of Trzeciak, Ser. No. 957,179, filed Nov. 2, 1978 and owned by the assignee of the present application.

In the Russian structure a spindle is rotatable in a drill pipe string and has a bit at its lower end. A fluid motor seats in the pipe and has its drive shaft engaged in the spindle to drive the bit. When the drill string is picked up, the motor is disengaged from the spindle and a clutch is engaged between the drill string and the spindle.

In the Trzeciak structure a bit sub has a torque transmitting connection with the drive shaft of an in-hole motor and thrust is transferred from the motor to the bit sub through a member which allows engagement of a clutch between the motor stator and the bit sub, when sufficient thrust load is applied downwardly on the bit. Thereafter, the bit can be rotated and pulled upon by the pipe string containing the motor.

BACKGROUND OF THE INVENTION

In the drilling of bore holes into or through earth formation, such as in the drilling of oil or gas wells, utilizing a rotary drill bit, it may occur, from time to time, that the bit may be stuck in the earth formation or debris in the bore hole. For example, this may occur either due to the caving in of the bore hole wall, or due to the formation of a key seat in the hard earth formation. When the bit is stuck, under such circumstances, it is difficult, if not impossible, to pull the drill string and bit from the bore hole. In the case of drilling by the usual rotary method, wherein the drill bit is attached to the lower end of a rotary string of drill pipe, it is the practice to rotate the drill pipe by the usual rotary table as an upward pull is being applied to the drill pipe, to assist in the release of the stuck bit.

In the case of in-hole motor drill assemblies of the electrical or fluid motor types, wherein the rotary drill bit is driven by the in-hole motor interposed between the running string and the bit, there is no positive interlock between the rotor and the drill string, so that it is not possible to cause the bit to rotate by rotation of the running or drill pipe string or fluid conduit above the motor. The reaction torque of such in-hole motors is, generally, taken by a rotary table at the surface of the bore hole, whereby the drill pipe string can either be held stationary or, if desired, rotated to obviate the wedging of the string. If the bit becomes stuck in the bore hole, such in-hole motors will stall and continued rotation of the bit may not be possible, notwithstanding the availability of additional drilling fluid pressure or electromotive force. As a consequence, when an in-hole motor drill has the drill bit stuck in the bore hole, an attempt can be made to pull the running pipe string and the motor drill from the bore hole, without rotating the bit, and various jarring devices have been utilized in the drill pipe string to assist in applying upward jarring forces to the drill pipe string and to the bit, in an effort to dislodge the latter.

In the event that the bit remains stuck, the practice has been to break the drill pipe joint above the motor drill assembly, if possible, in a known manner, whereby the drill pipe string can be retrieved to the drilling rig and, thereafter, to sidetrack the bore hole around the motor and bit which remain in the hole. Such practices result in great losses in time and costs.

Pending application Ser. No. 957,179, filed Nov. 2, 1978, by Trzeciak, relates to an in-hole motor drill apparatus, wherein the rotor of the motor is connected to the drill bit by a rotary drive connection through a clutch between the running string and the bit, including torque transmitting members, which can enable the stator or housing of the motor, in the event that the bit becomes stuck in the hole, to positively transmit torque to the bit, in response to rotation of the drill pipe string.

If the bit is stuck in soft formation, the application of additional weight may interfere with efforts to release the bit because the bit may be forced deeper into the formation in which it is stuck.

Furthermore, the bearing assemblies of in-hole motors have a pick-up or off bottom bearing which transmits upward thrust to the shaft when the housing is elevated to pull the assembly from the bore hole or allow circulation of fluid while the bit is off bottom. Such pick-up bearings normally limit the permissible longitudinal upward movement of the housing relative to the shaft, and, therefore, engagement of a clutch responsive to additional upward movement of the housing requires a predetetermined relationship in the structure of the pick-up bearing and the clutch to allow the additional movement required to engage the clutch.

SUMMARY OF THE INVENTION

The present invention relates to improvements in in-hole motor drill apparatus which has certain of the advantages disclosed in the above-identified applicaion, as well as other and further advantages and which does not require the imposition of an additional positive load on the bit to engage the clutch.

More particularly, the present invention provides a clutch device which can be engaged without increasing the weight applied to the bit. Specifically, the bit clutch of the present invention is engaged by applying a negative force or an upward strain or pull to the drill pipe and housing of the drilling structure to reduce or even remove the weight on the bit.

In normal drilling operation, weight of the drill string is much greater than the downward thrust desired to be imposed on the bit. A large fraction of the weight of the drill string is carried by the drilling lines which causes the drill string to be in tension above the drill collars which are relied on to impose the drilling weight on the bit.

In the case of an in-hole motor, the drilling weight imposed on the drill collars is carried on thrust bearings between the housing and the drill shaft which is, at one end, connected to the rotor and, at the other end connected to the bit.

It is a feature of the invention that a clutch is provided which is engaged when the downward load imposed on the bit is reduced, as by increasing the tension on the drill string and a reduction or complete elimination of the load on the thrust bearings. The result of this decrease in the load on the housing and the consequent reduction in load on the bit is the engagement of the clutch between the housing and the shaft.

It is thus one of the desirable features of the in-hole motor of our invention that when mounted in a drill string and connected to the bit, should the bit be stuck so as to be held against rotary movement, a pull on the drill string, with the consequent reduction in load on the bit, will cause a clutch to engage and permit introduction of a torsional stress sufficient to free the bit for rotation of the bit by rotation of the housing through the drill string.

The drilling apparatus of my invention avoids the danger, present in certain formations, that the imposition of a load on the bit in a substantial amount in excess of the drilling weight, at which it becomes stuck will have a negative effect on the ease of rotation and eventual withdrawal of the bit. The danger that added weight to the bit will wedge it more securely in the formation is avoided by the invention.

Other structures capable of engaging a bit clutch without increasing bit weight, which utilize drilling fluid to control clutch engagement are disclosed in my companion applications to which reference is hereby made (Docket 5532, now Ser. No. 055,373, filed July 6, 1979 and Docket 5533, now Ser. No. 067,756, filed Aug. 20, 1979). This function can be accomplished automatically by rotation of the running pipe, by an overrunning clutch, as disclosed in my companion application (Docket 5535) to which reference is hereby made.

In the normal drilling operation, it is occasionally necessary to lift the housing and in-hole motor and the bit. Lifting the in-hole motor causes a certain amount of longitudinal displacement of the housing and the shaft whereby the bearing which carries the drilling load is idle, and the full load of the drilling assembly is carried by the drilling lines, in which case the rotor and shaft and drill hang on a "pick-up" bearing between the shaft and the housing. In order to permit the rotor and shaft to be rotated, I provide that the clutch be in a disengaged mode under these conditions.

Such an arrangement is advantageous because it becomes desireable, in normal drilling practice, to be able to lift the bit off bottom of the hole while drilling fluid continues to flow through the motor causing rotation of the bit. Any longitudinal upward motion of the housing relative to the shaft which can occur when the bit is picked up off bottom must not normally cause the clutch to be engaged, since when the clutch is engaged the motor can not turn the shaft. However, provision is made that when the bit is stuck, the necessary longitudinal upward movement of the housing relative to the shaft, to engage the clutch, can occur, when a spring which normally does not deflect during pick up is caused to deflect sufficiently by additional pull on the pipe string. (See also my copending application Ser. No. 67,924, filed Aug. 20, 1979.)

When the bit is held against movement or is stuck, as described above, means are provided which permit a further longitudinal displacement of the housing and shaft in the same direction as normally will permit the shaft to be lifted with the housing without engaging the clutch. The further longitudinal displacement permits the engagement of the clutch.

The preferred bit clutch of this application has a novel relationship to the pick-up or off bottom bearing which allows the pick-up bearing to permit the longitudinal displacement to remove the drilling load on the bit without engaging the clutch. This permits the shaft to be rotated when off bottom. To engage the clutch, the pick-up bearing is designed so that an upward thrust is transmitted to the pick-up bearing from the housing through a thrust spring which is deformable to allow engagement of the clutch. When an upward pull in excess of that required during normal retrieval of the assembly or during off bottom circulation causes longitudinal movement of the housing relative to the shaft, the clutch is engaged. The pick-up bearing is designed to allow the necessary motion, when a predetermined pull is applied to the bit. In the presently preferred design, the spring deflection is such as to provide for the limited motion where the bit is off bottom and to engage the clutch when the housing is moved relative to the shaft when the bit is stuck.

Following the application of the necessary pull, say, 100,000 pounds, to engage the bit clutch of the present invention, the bit clutch is held in engagement so long as the pull is maintained. If desired, fluid can be forced through the stalled motor to assist in working the bit free. However, it is preferred that a circulation valve be installed in the pipe string above the motor, such valve enabling the fluid to bypass the motor and flow into the annulus. Circulation valves of this type are shown in Tschirky et al. U.S. Pat. No. 3,989,114 and in the application of Emery (Docket 5530). The combination of a circulation valve and a bit clutch is more particularly the subject of my application Ser. No. 055,690, filed July 6, 1979 (Docket 5545).

Following release of the bit, if possible, by the combination of manipulative steps including rotation, in either direction, while applying an upward force, the apparatus can be recovered from the bore hole for serivce.

Certain bearing assemblies for in-hole motors are lubricated by the flow of a certain portion of the drilling fluid through the space between the shaft and the housing in which the bearings are located, and the present invention is shown in such a bearing assembly. However, since the clutch structure of the present invention is responsive to pull applied to the pipe to elevate the bearing housing relative to the shaft, the clutch components can also be incorporated in a sealed or lubricated bearing housing, such as that shown, for example, in the pending application of Geczy and Tschirky, Ser. No. 818,423, filed July 25, 1977 for Sealed Bearing Means For In-Hole Motors.

When the clutch is engaged, in response to the upward pull, the thrust is transferred from a clutch member in the housing to a clutch member on the shaft, thereby protecting the pick-up bearing against excessive and damaging thrust loads.

If the bit cannot be released, the pipe string can be torqued to the left, to a certain extent, and thereafter a so-called "string shot" can be employed in an effort to explosively release a pipe joint above the motor assembly, so that the pipe string above the motor can be retrieved.

A jarring device of a well known type may be installed in the pipe string D to produce an impact force tending to jar the stuck bit free. Preferably, in use, tension is applied to the pipe string to engage the clutch, so that the jarring force acts upwardly on the shaft through the clutch.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

BRIEF DESCRIPTION OF THE DRAWINGS

FIGS. *2a*, and *2b* together, constitute an enlarged longitudinal section, as taken on the line 2—2 of FIG. 1, showing the bit clutch construction in the bearing assembly, with the clutch disengaged.

Figure 1:
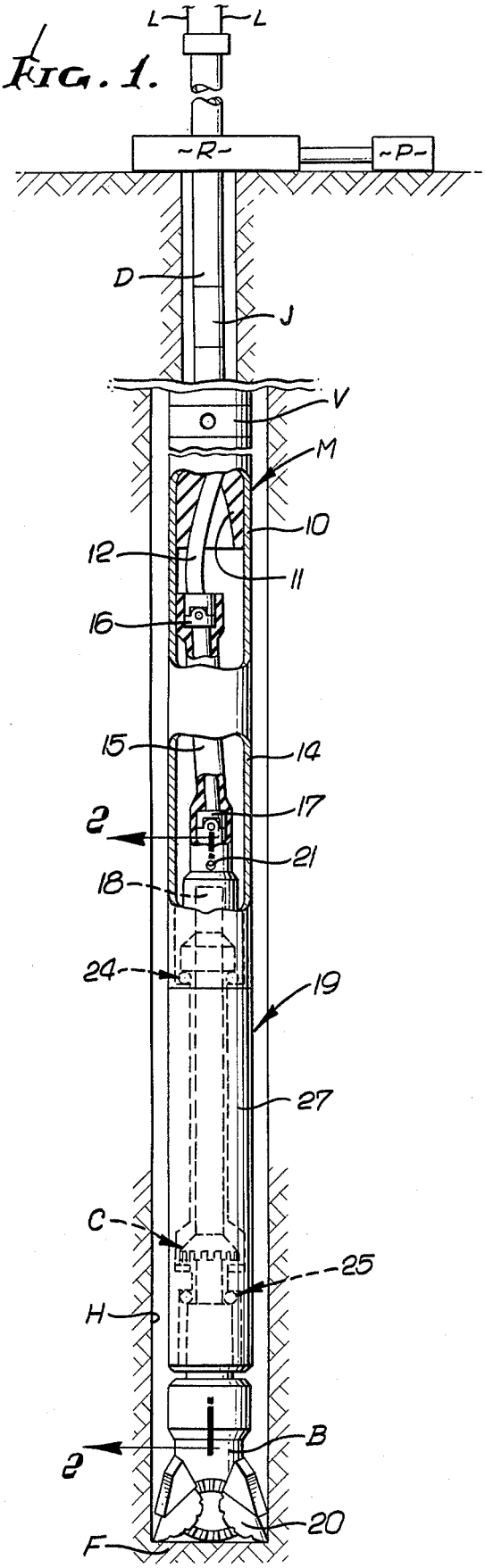
FIG. 1 is a view diagramatically showing an in-hole motor drill, partly in elevation and partly in section, in an earth bore hole, and incorporating clutch structure in accordance with the invention, engageable by applying an upward pull on the drilling lines.

As seen in the drawings, referring first to FIG. 1, an in-hole motor assembly M is connected to the lower end of a string of drilling fluid conducting drill pipe D and has its housing 10 providing a progressing cavity stator 11 for a rotatable helicoidal rotor 12. The illustrative motor is a positive displacement-type fluid motor of a known-type. The rotor is driven by the downward flow of fluid supplied to the pipe string from the usual pump P provided on a drilling rig having a rotary R which can rotate the pipe D which is suspended by the usual drilling lines L of a derrick or rig (not shown). The fluid passes downwardly through the pipe D, in which a circulation valve V is installed, into a connecting rod housing section 14 which contains a connecting rod assembly 15, connected by a universal joint 16 to the lower end of the rotor 12 and by a universal joint 17 to the upper end of the drive shaft 18. The drive shaft extends downwardly through a bearing assembly 19, and at its lower end, the drive shaft is connected to a drill bit B, having cutters 20 adapted to drill through the earth formation F, in the drilling of a bore hole H. The drive shaft 18 is tubular and has, adjacent its upper end, inlet ports 21, through which the drilling fluid passs from the connecting rod housing 14 into the elongated central bore 22 of the drive shaft, the fluid exiting from the bit B to flush cuttings from the bore hole and cool the bit. When the circulation valve V is open, the fluid bypasses the motor and flows into the annulus.

During operation of the fluid motor M, the lower end of the rotor 12 has an eccentric motion which is transmitted to the drive shaft 18 by the universal connecting rod assembly 15, and the drive shaft 18 revolves about a fixed axis within the outer housing structure 23 of the bearing assembly 19, the drive shaft being supported within the housing by bearing means 24 and 25 shown in FIGS. *2a–2c*.

The bearing assembly 19 is exemplary and may be constructed like that of U.S. Pat. No. 4,029,368 which is mud lubricated and a certain amount of the total volume of the circulating fluid is allowed to flow through the bearings, at a rate determined by flow restrictor sleeves, due to the differential pressure caused by the restricted flow of the majority of the circulating or drilling fluid through the bit nozzles, as is well known. The bearing of that patent and all the bearing assemblies of the same general type have set down bearings to transmit axial load from the drill string to the bit, through the drive shaft, and pick-up or off bottom bearings by which the bit is pulled from the hole, when the drill string is pulled. The bearing assembly may also be sealed, is disclosed in pending application, Ser. No. 819,423, filed July 25, 1979.

In the case of the bearings 24 and 25, generally illustrated in FIG. 1, the bearing means 24 is a pick-up bearing, while the bearing means 25 is the set down bearing, as will be well understood as will be more fully described below.

The invention provides a clutch C (FIG. *2b*), between the shaft 18 and the housing 23 of the bearing assembly 19. In the form shown, the clutch C is normally disengaged, but is adapted to be engaged, if the bit is stuck, when an upward pull is applied to the pipe string D tending to raise the drilling assembly in the bore hole. Upward pull in the pipe D can be augmented by a jarring force applied to the pipe by a jar J of any well known type, such as that made by Bowen Tools, Inc., and illustrated in COMPOSITE CATALOG, Vol. 1, 1976–77, pg. 733, Gulf Publishing Company, Houston, Tex.

Referring to FIGS. *2a* and *2b*, it will be seen that the elongated tubular shaft is connected at one end, specifically at its upper end, by a threaded joint 18*a* to a connector cap 18*b* which contains the inlet ports 21 and which connects the upper end of the shaft to the universal joint 17 by a threaded connection. At its other or lower end, the shaft 18 extends from the housing 27 of the bearing assembly 19, and has an enlarged, lower bit connector 26, to which the threaded pin of the bit B is connected, in the usual manner.

The drilling fluid which is circulated by the pump P, downwardly through the pipe string D and through the motor M, as previously indicated, finds access to the passage 22 through the shaft 18, by the ports 21, and a certain limited portion of the drilling fluid is permitted to flow between the housing and the shaft to lubricate the bearings 24 and 25. Alternatively, it will be understood by those skilled in the art that the bearing assembly may be of a sealed construction, such as that disclosed in the above-identified application of Geczy and Tschirky. In the illustrative form, the flow of drilling fluid through the bearings of the bearing assembly is restricted by flow restrictor means 28 (FIG. *2a*) which may also constitute a radial bearing. Such radial bearings are well known and disclosed in the patent granted to Tschirky and Crase on June 14, 1977, U.S. Pat. No. 4,029,368.

As seen in FIG. *2a*, the drive shaft 18 extends downwardly from the connector cap 18*b*, to which it is connected at its upper end, and projects or extends from the lower end of the housing, for connection to the bit B. The pick-up or off-bottom bearing 24 is seen in FIG. *2a*, while the set down or drilling bearing 25 is seen in FIG. *2b*. The bearing 24 includes a lower race 30 pinned or otherwise suitably secured for rotation with the housing 27, as by means of pins 31. Above the lower race 30 is an upper race 32, and bearing balls 33 are disposed in raceways provided in the respective races 30 and 32, whereby thrust is transmitted upwardly, upon upward movement of the housing 27 from an upwardly facing shoulder 34 provided at the upper end of the housing section 27, through the balls 33, to the upper pick-up bearing race 32. A suitable number of Belleville springs 35 are interposed between the upper bearing race 32 and the lower end of the connector cap 18*b*, the Belleville springs 35 constituting a resilient means which maintain a spring load upon the balls 33 and races 30 and 32 during operation of the device in the drilling of the bore hole, whereby the bearing 24 does not run freely.

The Belleville springs 35 are also adapted to enable a certain amount of relative longitudinal movement of the housing with respect to the shaft, in the event that the bit becomes stuck, and an upward pull is applied to the running pipe string D, sufficient to cause engagement of the clutch means C, as will be later described.

Figure 2B:
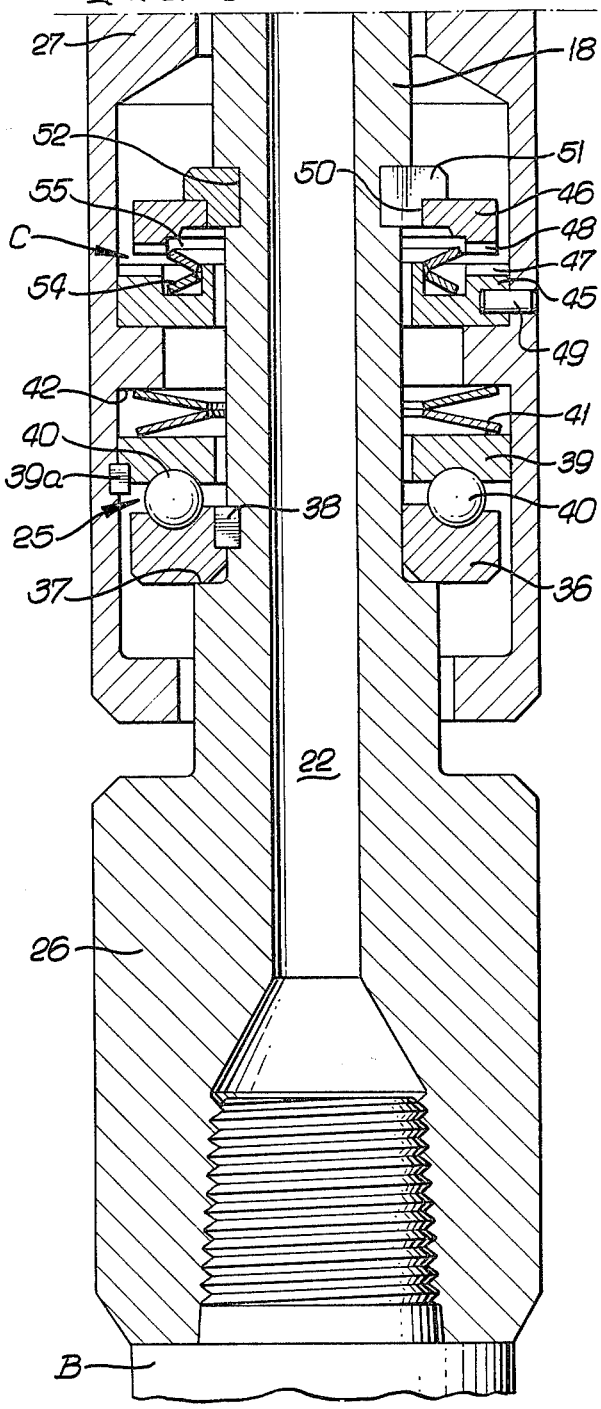
Figure 2A:
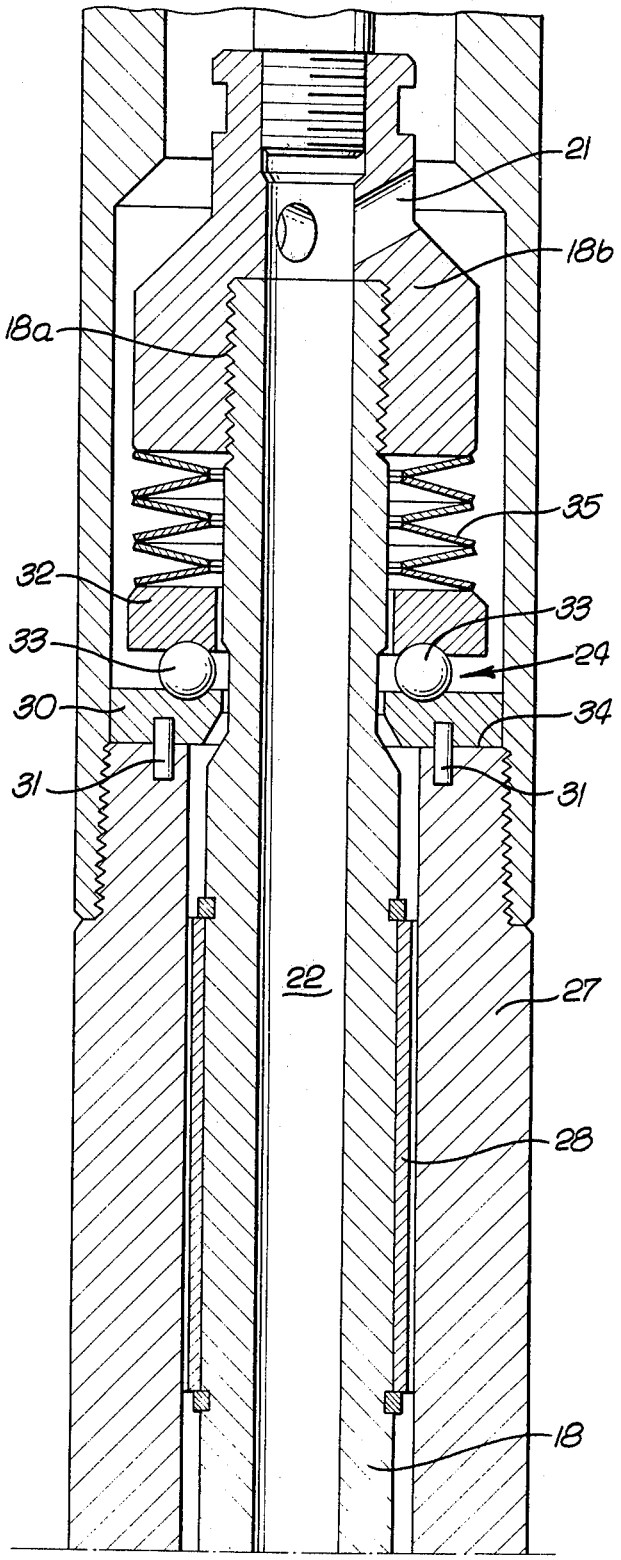

Referring to FIG. 2*b*, the set down bearing 25 includes a lower race 36 which seats upon an upwardly facing shoulder 37 on the shaft 18 and which is keyed to the shaft for rotation therewith, as by suitable means such as a key 38. An upper bearing race 39 opposes the lower race 36, and is keyed to the housing at 39*a*, and the bearing balls 40 are disposed in raceways provided in the opposing races 36 and 39. In the illustrated form, the drilling or set down bearing 25 is also provided with shock absorbing springs, shown as a set of Belleville springs 41, which engage a downwardly facing shoulder 42 provided in the housing and the upper surface of the upper bearing race 39, whereby to absorb shock during the vertical excursions of the shaft caused by rotation of the bit on the bottom of the bore hole. As previously indicated, such spring loaded bearing assemblies are well known and may take various forms, and the structure herein illustrated is of a simple construction for the purpose of illustrating the capability of the housing to apply a downward drilling thrust and an upward pull to the bit B.

The construction of the set down bearing 25 is not germane to the present invention; nor is the construction of the pick-up bearing 24 germane to the present invention, except to the extent that the Belleville springs 35 be sufficiently resistent to deflection to enable the shaft 18 to be elevated, upon upward movement of the housing 27, to lift the bit B off the bottom of the hole, during off bottom circulation, but being deflectable, in the event that the bit be stuck, to allow sufficient longitudinal movement of the housing 27 of the bearing assembly 19 upwardly with respect to the shaft 18, to cause engagement of the clutch C, without requiring that any additional load be applied to the bit.

Referring to FIG. 2*b*, the clutch C will be seen to comprise a pair of torque transmitting members 45 and 46 having jaw clutch teeth 47 and 48. The clutch member 45 is a ring secured within the housing for rotation therewith, as by suitable pins 49, while the clutch member 46 is a companion ring secured to the shaft 18 by, for example, an eccentric fit 50 with a split thrust collar 51 which is disposed in an eccentric groove 52 provided in the shaft 18, whereby upon assembly, the eccentric relationship of the thrust collar 51 to the shaft, and the eccentric relationship of the clutch ring 46 to the thrust collar 51, prevent relative rotation of the shaft with respect to the clutch ring 46. Clearly, means such as keys or pins, may be employed to connect the clutch ring 46 to the shaft for mutual rotation and for thrust transmission.

As previously indicated, during normal drilling operations, it is desired that the clutch C remain disengaged. This is accomplished during off bottom circulation, by the resistance of the Belleville springs 35 to deflection. The Belleville springs 35, therefore, are selected so that they not only maintain a resilient bias upon the pick-up bearing 24 during drilling operations, but the springs 35 are also sufficiently resistant to deflection to enable the shaft 18 and bit B to be held off bottom, during circulation of drilling fluid, and to maintain the clutch rings 45 and 46 in the axially spaced condition shown in FIG. 2*b*.

Figure 3:
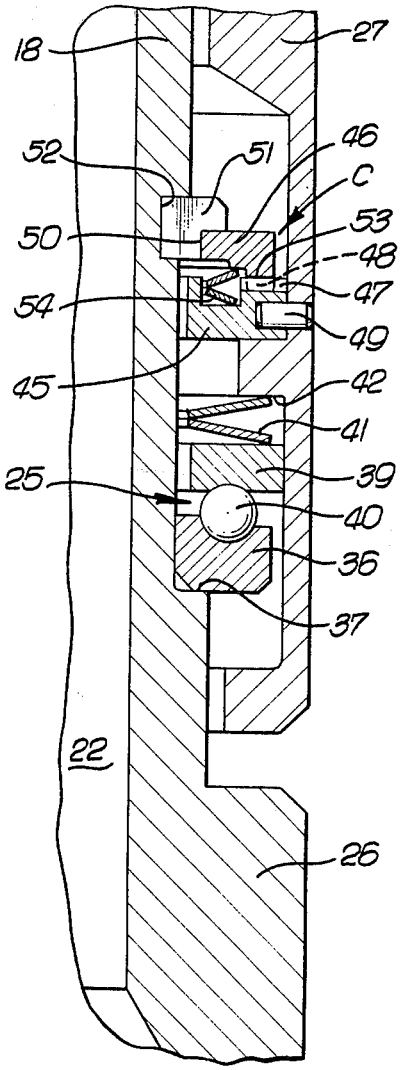
FIG. 3 is a view corresponding to FIG. *2b*, but showing the clutch engaged.

However, if the bit B is stuck in the hole, when upward thrust is applied to the bearing housing 27, causing deflection of the springs 35, of the pick-up bearing assembly 24, the springs 35 will allow upward movement of the housing 27 relative to the shaft 18 sufficient to bring the clutch teeth 47 and 48 into engagement. Thereafter, when the clutch rings 45 and 46 are engaged, as seen in FIG. 3, upward thrust will be transmitted from the clutch ring 45 to the clutch ring 46, at the coengaged transverse surfaces 53, and from the clutch ring 46, through the thrust collar 51, to the shaft 18, so that the upward thrust applied in an effort to release the bit is not applied to the shaft through the pick-up bearing assembly 24.

Furthermore, in the illustrated form, it will be seen that a set of Belleville springs 54 are disposed between the opposing clutch rings 45 and 46, and that as seen in FIG. 2*b*, a clearance space 55 is provided between the upper Belleville spring 54 and an opposing shoulder provided in the upper race 46, so that the Belleville springs 54 are, in effect, inactive, until the upward thrust tending to move the bearing housing 27 upwardly exceeds the resistance of the pick-up bearing springs 35 and sufficient motion occurs to take up the clearance space 55, at which time the springs 54 are effectively in parallel relationship with the pick-up bearing springs 35. Thereupon, additional upward pull causes further deflection of the pick-up bearing springs 35 and deflection of the clutch springs 54, until the clutch teeth 47 and 48 are coengaged. At this time, the housing and the shaft are interconnected by the clutch means C for mutual rotation.

Accordingly, the rotary table R can be operated to cause rotation of the drill string D and rotation of the housing structure 10, comprising the motor housing 10 and the bearing housing 27, and such rotation can be translated to the bit, through the clutch means C. If the bit becomes free, the upward force applied by the lines L to the pipe string D can be relaxed, enabling the bit to again be lowered to the bottom of the hole, as the bit is being rotated by the circulation of fluid downwardly through the motor M and through the bit B, or, alternatively, the apparatus can be removed from the hole for service or repair.

In the form shown, the pick-up bearing springs 35 enable the necessary clutch engaging longitudinal movement of the housing relative to the shaft, but other structures can be utilized to enable the necessary motion, such as a connection releasable by applied load in excess of the normal load. In the latter case, only the clutch springs 54 need be deflected to cause engagement of the clutch.

From the foregoing, it will be apparent that the present invention provides a novel and simple clutch structure in the in-hole motor bearing assembly, whereby the structure can be connected to the running pipe string, at the well site, and a bit then can be connected to the lower end of the drive shaft, and that if the bit becomes stuck during the drilling operations, the usual inability to rotate the stuck bit by rotation of the pipe string is overcome.

I claim:

1. An in-hole motor assembly adapted for connection with a rotatable pipe string and a bit, said assembly comprising: a motor stator including a housing structure adapted to be installed in a pipe string; a rotor in said stator; a shaft connected at one end to said rotor for rotation therewith and extending at its other end from said housing to drive a drill bit; thrust bearings between said shaft and said rotor and said housing; a clutch engageable between said shaft and said housing to couple said housing and shaft for mutual rotation upon predetermined movement of said housing, relative to said shaft, in a direction away from the other end of said shaft.

2. An in-hole motor as defined in claim 1; including a spring acting between said shaft and said housing resisting said relative longitudinal movement and permitting such movement when a predetermined load on said spring deflects said spring.

3. An in-hole motor as defined in claim 1; including a spring resisting said relative longitudinal movement and permitting such movement when a predetermined load on said spring deflects said spring, said spring being in said clutch.

4. An in-hole motor as defined in claim 1; including a spring resisting said relative longitudinal movement and permitting such movement when a predetermined load on said spring deflects said spring, said thrust bearings including said spring in a bearing which transmits thrust from said housing to said shaft in the direction of said one end.

5. An in-hole motor as defined in claim 1; including springs in said clutch and a spring in said bearings which transmit thrust from said housing to said shaft in the direction of said one end to resist engagement of said clutch.

6. An in-hole motor as defined in claim 5; said springs being in parallel relation.

7. An in-hole motor as defined in claim 5; said springs being in parallel relation, said spring in said clutch providing a gap enabling deflection of said spring in said bearing before deflection of said spring in said clutch.

8. An in-hole motor as defined in claim 1; said clutch including a driven member connected to said shaft, a drive member connected to said housing, said driven and drive members having surfaces extending transversely of the assembly and engageable upon engagement of said clutch to transmit thrust from said housing to said shaft in the direction of said one end.

9. An in-hole motor as defined in claim 1; including a member interposed between said housing and said shaft restraining said predetermined movement of said housing.

10. An in-hole motor adapted for connection with a rotatable pipe string and a bit, said assembly comprising: a motor stator including a housing structure connectable at one end to a pipe string, a rotor in said stator, a shaft connected at one end to said rotor and extending at its other end from the other end of said housing, thrust bearings to transmit thrust from said housing to said shaft towards said one end and towards said other end of said shaft, said bearings being constructed to permit limited relative longitudinal movement of said housing relative to said shaft towards said one end, clutch members on said housing and on said shaft engageable upon longitudinal movement of said housing relative to said shaft towards said one end, a restraining member preventing further longitudinal movement of said housing relative to said shaft following said limited longitudinal movement to prevent engagement of said clutch members, said restraining member permitting said additional longitudinal movement when said shaft is held against movement with said housing upon said limited longitudinal movement.

11. An in-hole motor as defined in claim 10, said restraining member being a spring in said bearings.

12. A in-hole motor as defined in claim 10, said restraining member being a spring between said clutch members.

13. An in-hole motor assembly comprising: a motor drill having a housing and a shaft, said housing including a stator and a rotor, said rotor being connected with said shaft, a jar connected with said housing to apply a longitudinal thrust and a shock load to said housing, a normally disengaged clutch including members in said housing and on said shaft engageable to transmit torque and thrust to said shaft from said housing, and a bearing between said shaft and housing in thrust relation to said housing and said shaft for transmution of thrust from said housing to said shaft when said clutch is engaged and also when disengaged.

14. The method of connecting a housing to a shaft of fluid driven motor drill apparatus in a bore hole, comprising: running a fluid driven motor drill into a bore hole on fluid conducting running pipe, said motor including a stator and a rotor connected to a drill, driving the motor drill while applying drilling force to said motor drill, circulating fluid through said running pipe and said stator and said drill, connecting said motor drill to said running pipe for mutual rotation without increasing said drilling weight by applying a torque on said drill and an upward pull on said running string and said drill.

15. The method of claim 14, including transferring the thrust from said housing to said shaft by engaging a clutch when said upward pull moves said housing relative to said shaft.

16. The method of connecting a housing to a shaft of fluid driven motor drill apparatus in a bore hole, comprising: running a fluid driven motor drill into a bore hole on a fluid conducting running pipe, driving the motor drill while applying drilling force to said motor drill by circulating fluid through said running pipe and said motor drill, connecting said motor drill to said running pipe for mutual rotation without increasing said drilling weight by applying an upward pull on said running string to overcome a thrust transmitting connection between said housing and said shaft, and rotating said running pipe while applying a longitudinal force to said motor drill.

17. The method of claim 16, including applying a jarring force to said motor drill by increased upward pull on said running pipe.

18. An in-hole motor comprising a housing connectable to a drilling string, a stator in said housing, a rotor in said stator, a shaft connected at one end to said rotor and connectable to drill at the other end, bearings between said shaft and said housing, said housing and said shaft being displaceable relative to each other on application of a thrust in a direction towards one end or the other end of said shaft, a clutch between said shaft and said housing, resistance to said displacement of said shaft and said housing to keep said clutch disengaged on application of limited thrusts and said resistance being insufficient to overcome increased thrusts whereby said housing and shaft are displaced sufficient to engage said clutch.

19. The in-hole motor of claim 18, in which said resistance is a yieldable resistance permitting said displacement to engage said clutch.

20. An in-hole motor of claim 18, in which said thrust overcomes said resistance is in a direction towards the end of said shaft connectable to a bit.

21. An in-hole motor assembly adapted for connection with a rotatable pipe string and a bit, said assembly comprising a motor stator including a housing structure adapted to be installed in a pipe string; a rotor in said stator; a shaft connected at one end to said rotor for rotation therewith and extending at its other end from said housing for connection to a drill bit; thrust bearings between said shaft and said housing; a clutch engageable between said shaft and said housing to couple said housing and shaft for mutual rotation upon predetermined movement of said housing, relative to said shaft in a direction away from the other end of said shaft, springs in said clutch and a spring in said bearings which tramsmit thrust from said housing to said shaft in the direction of said one end to resist engagement of said clutch.

22. An in-hole motor adapted for connection with a rotatable pipe string and a bit, said assembly comprising a motor stator including a housing structure adapted to be installed in a pipe string; a rotor in said stator; a shaft connected at one end to said rotor for rotation therewith and extending at its other end from said housing to drive a drill bit; thrust bearings between said shaft, a spring associated with said bearings and said housing; a clutch engageable between said shaft, a spring associated with said clutch and said housing to couple said housing and shaft for mutual rotation upon predetermined movement of said housing relative to said shaft, in a direction away from the other end of said shaft, said springs being in parallel relation.

23. An in-hole motor adapted for connection with a rotatable pipe string and a bit, said assembly comprising a motor stator including a housing structure adapted to be installed in a pipe string; a rotor in said stator; a shaft connected at one end to said rotor for rotation therewith and extending at its other end from said housing to drive a drill bit; thrust bearing between said shaft and said housing, a spring associated with said bearing; a clutch engageable between said shaft and said housing to couple said housing and shaft for mutual rotation upon predetermined movement of said housing, a spring associated with said clutch relative to said shaft, said springs being in parallel relation, said spring in said clutch providing a gap enabling deflection of said spring in said bearing before deflection of said spring in said clutch.

* * * * *